US010900756B2

(12) United States Patent
Murray et al.

(10) Patent No.: US 10,900,756 B2
(45) Date of Patent: Jan. 26, 2021

(54) FURTHER IMPROVED FLEXIBLE LINEAR CHARGE SYSTEM

(71) Applicant: Applied Explosives Technology Pty Limited, Moore Park (AU)

(72) Inventors: Chris Murray, Moore Park (AU); Steven Richard Courtley, Moore Park (AU)

(73) Assignee: APPLIED EXPLOSIVES TECHNOLOGY PTY LIMITED, NSW (AU)

( * ) Notice: Subject to any disclaimer, the term of this patent is extended or adjusted under 35 U.S.C. 154(b) by 0 days.

(21) Appl. No.: 16/235,218

(22) Filed: Dec. 28, 2018

(65) Prior Publication Data

US 2020/0191535 A1 Jun. 18, 2020

(30) Foreign Application Priority Data

Dec. 17, 2018 (AU) ..... 2018282259

(51) Int. Cl.
*F42B 1/028* (2006.01)

(52) U.S. Cl.
CPC ..... *F42B 1/028* (2013.01)

(58) Field of Classification Search
CPC ..... F42B 1/02; F42B 1/028; F42B 1/036
USPC ..... 102/306, 307
See application file for complete search history.

(56) References Cited

U.S. PATENT DOCUMENTS

| | | | | | |
|---|---|---|---|---|---|
| 2,513,233 | A * | 6/1950 | Byers | F42B 1/028 | 102/306 |
| 2,605,704 | A | 8/1952 | Dumas | | |
| 3,371,605 | A * | 3/1968 | Eckels | F42B 1/02 | 102/331 |
| 4,418,622 | A * | 12/1983 | Foster | F42B 1/02 | 102/289 |
| 4,641,581 | A * | 2/1987 | Weickert | F42B 3/24 | 102/307 |
| 5,036,771 | A * | 8/1991 | Alford | F42B 3/08 | 102/307 |
| 7,536,956 | B2 * | 5/2009 | Sammons | F42B 1/036 | 102/476 |
| 8,146,503 | B2 | 4/2012 | Murray et al. | | |
| 2015/0013561 | A1 * | 1/2015 | Chartier | F42B 1/028 | 102/307 |
| 2015/0219427 | A1 * | 8/2015 | Alford | F42B 1/028 | 102/307 |
| 2019/0390943 | A1 * | 12/2019 | Lumley | F42B 1/028 | |

FOREIGN PATENT DOCUMENTS

| | | |
|---|---|---|
| AU | 2003283125 B2 | 6/2004 |
| GB | 1520250 A | 8/1978 |

* cited by examiner

*Primary Examiner* — Bret Hayes
(74) *Attorney, Agent, or Firm* — Hayes Soloway PC

(57) ABSTRACT

A field filled, flexible linear charge system for cutting through material by explosive detonation; the system including a flexible carcass for application to a surface; the carcass adapted for filling with an explosive compound at a site of use.

15 Claims, 14 Drawing Sheets

FURTHER IMPROVED FLEXIBLE LINEAR CHARGE SYSTEM

TECHNICAL FIELD

The present invention relates to explosive cutting techniques and, more particularly, to linear charges adapted to field preparation.

BACKGROUND

It is known to use explosives as cutting agents for penetration of hard surfaces. Thus, AU2003283125 by the present inventor for example, describes various forms of linear shaped charges. Another example is that disclosed in U.S. Pat. No. 4,693,181 to Dadley.

A disadvantage of these systems is that the charges are prefabricated by the manufacturer as a range of flexible linear cutting charges each with nominated grams of explosive per meter (g/m) loadings—the current range of flexible linear charges described under AU 2003283125 for instance, are 100, 240, 380, 520, 750 and 1120 g/m.

These charges are provided in various lengths according to user requirement, for example, 2 meters, 3.2 meters being most common. As these charges have both a liner and tamper made of rubberised dense metal carbides or rubberised dense metal, the overall mass of these charge lengths can tend to be high, thus providing potential difficulties in individual trooper carrying capacity, which may affect endurance and combat performance of the trooper.

Another potential disadvantage is that the current inventory of combat engineering explosives includes both flexible linear charges and plastic explosive, as well as other specialised shaped charges for demolition tasks.

It may be advantageous to reduce the number of types of explosive charges carried by combat engineers, resulting in less mass having to be carried and a reduction in the number and quantity of explosive charges, thus simplifying the explosives inventory that needs to be carried, transported and stored by military personnel.

It is an object of the present invention to address or at least ameliorate some of the above disadvantages or provide a useful alternative.

Notes

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

SUMMARY OF INVENTION

Accordingly, in a first broad form of the invention, there is provided a field filled, flexible linear charge system for cutting through material by explosive detonation; the system including a flexible carcass for application to a surface; the carcass adapted for filling with an explosive compound at a site of use.

Preferably, the carcass is formed as a perimeter for an aperture to be cut through a sheet of material.

Preferably, the carcass is placed around a perimeter of a metal pipe to be severed.

Preferably, the carcass is placed across a width or length of a sheet of material to cut the sheet into two sections.

Preferably, the carcass is formed of a closed cell flexible foam; the carcass including a trough extending downwardly from an opening in an upper surface of the carcass; the trough adapted for receiving the explosive compound.

Preferably, a bottom portion of the trough includes an upwardly curved projection extending the length of the carcass.

Preferably, the upwardly curved projection is flanked by respective first and second side channels along each side of the upwardly curved projection.

Preferably, the upwardly curved projection is clad with a liner formed as a composite of an elastomer and a metal or metal compound or mixtures of these materials in powdered form.

Preferably, the metal or metal compound in powdered form is copper, tungsten, tungsten carbide, tungsten boride, molybdenum, zirconium, iron, rare earth metals, magnesium, aluminium or mixtures of these materials.

Preferably, the width of the opening at the upper surface of the carcass is the same as the width extending across the bottom portion of the trough from first side channel to second side channel; side walls of the trough extending vertically from outer edge of the side channels.

Preferably, the opening at the upper surface of the carcass is a narrowed opening; the width of the narrowed opening being less than the width extending across the bottom portion of the trough; the side walls of the trough forming a necked profile comprising vertical wall portions and sloping shoulder portions extending to the narrowed opening.

Preferably, side walls of the trough are lined with inertial mass tamping strips.

Preferably, the inertial mass tamping strips are formed as a composite of an elastomer and a metal or metal compound in powdered form; the metal being tungsten, tungsten carbide, tungsten boride, copper, iron or mixtures of these materials.

Preferably, the carcass is covered by a closed foam carcass cover of width substantially equal to the width of the carcass; the closed foam carcass cover including an embedded inertial mass tamping strip of width equal to or greater than the width of the opening in the upper surface of the carcass.

Preferably, the inertial mass tamping strips comprise composite of an elastomer and a metal or metal compound in powdered form; the metal selected from copper, iron, tungsten, tungsten carbide, tungsten boride, or mixtures of these materials.

Preferably, the narrowed opening may be provided with a tamping cap.

In another broad form of the invention, there is provided a method for cutting through a material by explosive detonation; the method including the steps of:

- affixing a flexible linear carcass to the surface of the material;
- filling a trough in the carcass through an opening in an upper surface of the carcass with an explosive compound,
- attaching at least one detonating assembly to the carcass filled with the explosive compound.

Preferably, in a further step, the flexible linear carcass is covered by a carcass cover.

Preferably, side walls of the trough of the flexible linear carcass are provided with inertial mass tamping strips.

Preferably, the carcass cover is provided at an under side of the carcass cover with an inertial mass tamping strip of a width at least equal to the width of the trough in the flexible linear carcass.

Preferably, a bottom portion of the trough is formed as a curved upward projection; a surface of the curved upward projection clad with a liner comprising an elastomer impregnated with powdered metal or metal compound or mixtures of these materials.

Preferably, the cutting through of the material is in the form of an aperture; the carcass defining a shape of the aperture.

Preferably, the cutting through of the material is the severing of a metal pipe.

Preferably, the cutting through of the material is a cut across the width or length of a sheet of the material.

In another broad form of the invention, there is provided a field filled, flexible linear charge system for cutting through material by explosive detonation; the system including assembling on site components to form a charge defining a shape of the cutting through; the components including at least one carcass section, a carcass cover, inertial mass tamping strips and liners.

Preferably, the carcass includes a trough adapted for filling on site with an explosive material.

In a further broad form of the invention, there is provided a kit of components for constructing a field fillable, flexible linear charge system; the kit including lengths of flexible carcasses, optional tamping strips, one or more selected explosives and detonating cord and igniters.

In yet another broad form of the invention, there is provided a flexible linear charge system; the system including a foam base or carcass provided with an upwardly arching central projection; the upwardly arching projection overlaid with a liner; the system further including a carapace providing a cover over the carcass and the liner; the carapace leaving a space between an upper surface of the liner and the inside surface of the carapace.

Preferably, the carapace extends along the outer sides of the carcass to be level with an underside of the carcass.

Preferably, the space between the upper surface of the liner and the inside surface of the carapace is fillable with an explosive material.

Preferably, the space between the upper surface of the liner and the inside surface of the carapace is prior filled with explosive material at manufacture of the system.

BRIEF DESCRIPTION OF DRAWINGS

Embodiments of the present invention will now be described with reference to the accompanying drawings wherein.

DESCRIPTION OF EMBODIMENTS

First Preferred Embodiment

Figure 1:
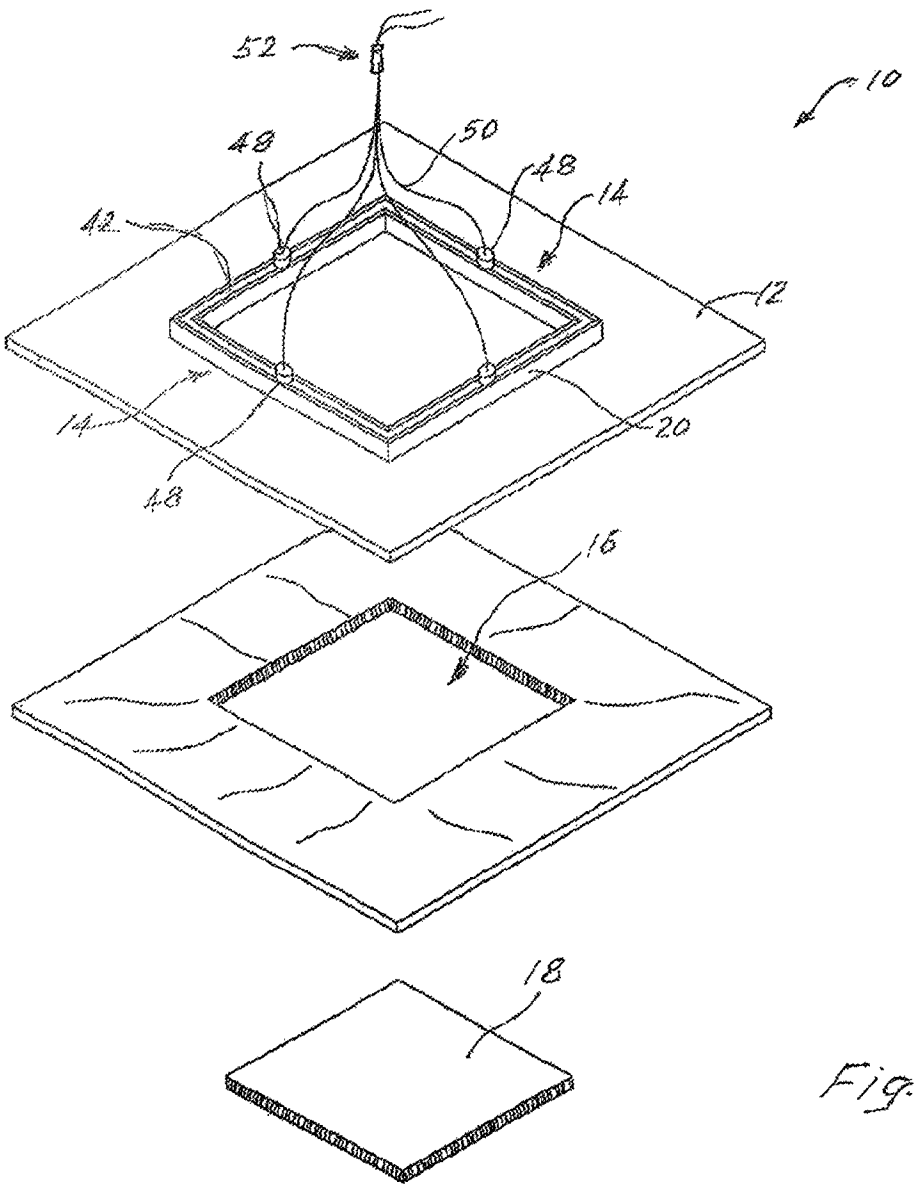
FIG. 1 is a perspective view showing an example of a field filled flexible linear charge system according to the invention, in use.
Figure 2:
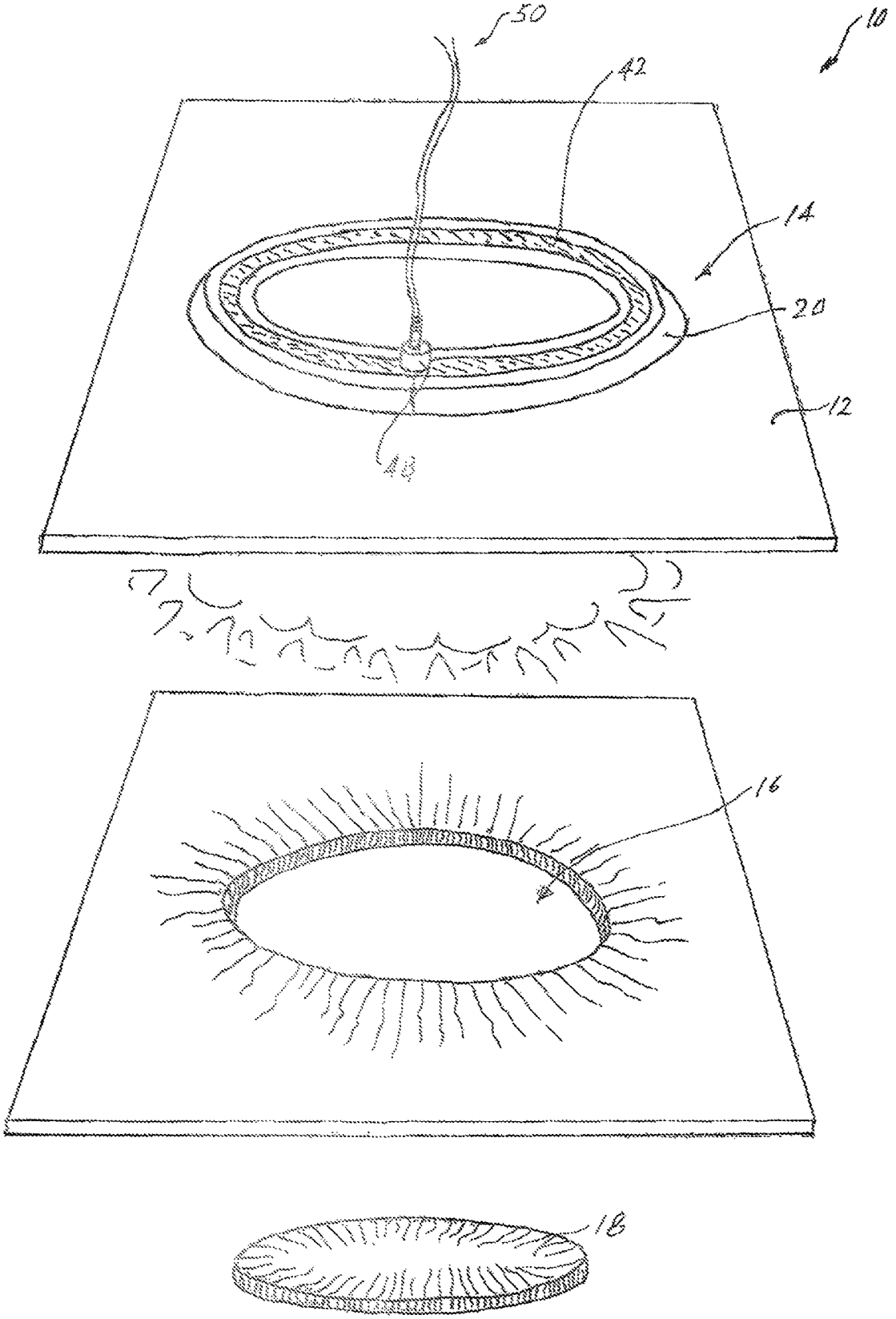
FIG. 2 is perspective view of a further example of the system of FIG. 1, FIGS. 3A to 3D are sectioned views of examples of carcasses of the flexible linear charge system, FIGS. 4A to 4D sectioned views of the carcasses of FIGS. 3A to 3D fitted with a carcass cover, mass tamping strips and a liner.

With reference to FIGS. 1 and 2, the filled flexible linear charge system 10 of the invention allows the cutting of apertures in hard surfaces such as steel plate 12 by linear charges assembled on site. FIGS. 1 and 2 show the sequence of the method of use in which a suitably shaped explosive element 14 forms a perimeter defining the shape of the desired aperture 16. Detonation of the explosive element 14 cuts through the surface 12, creating the aperture 16 and the cut out section 18 of the plate 12.

The explosive element of the system 10 makes use of a carcass 20 formed into a perimeter for the desired aperture 16. With reference now also to FIGS. 3A to 3D, the carcass 20 is formed, for example as an integral extrusion (or an assembly of sections 20A, 20B and 204C as shown by dashed lines) of a closed cell flexible foam to form a trough 22 extending downwardly from an upper surface 21 of the carcass 20. The trough 22 is adapted for receiving an explosive compound 24, preferably a plastic explosive such as PE 4.

As can be seen in FIGS. 3A to 3D, a bottom portion 20 of the trough 22 includes an upwardly curved projection 24 extending the length of the carcass 20. Preferably, the upwardly curved projection 24 is flanked by respective first and second side channels 25, 26 along each side of the upwardly curved projection 24.

Figure 3A:
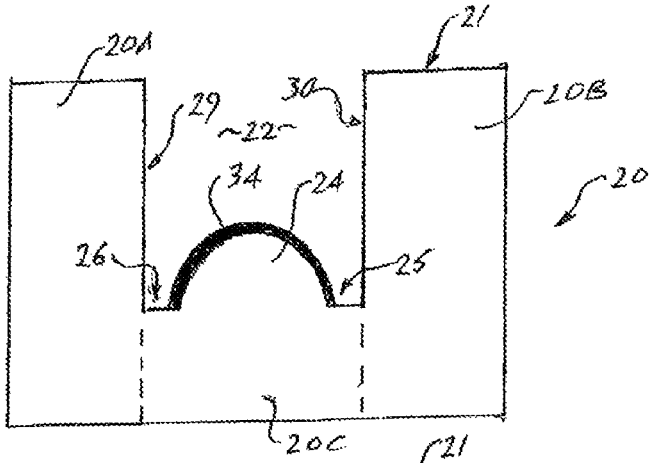
Figure 3B:
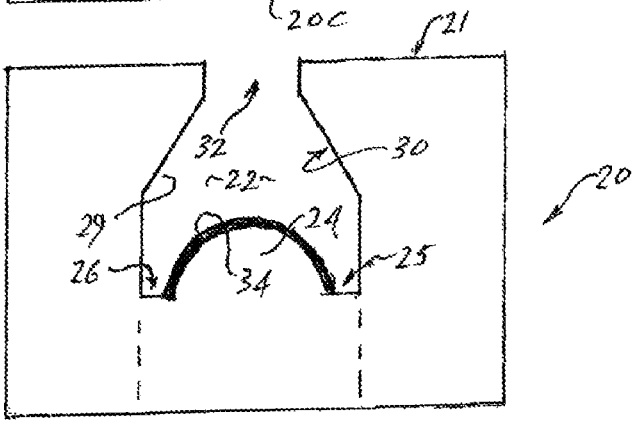
Figure 3C:
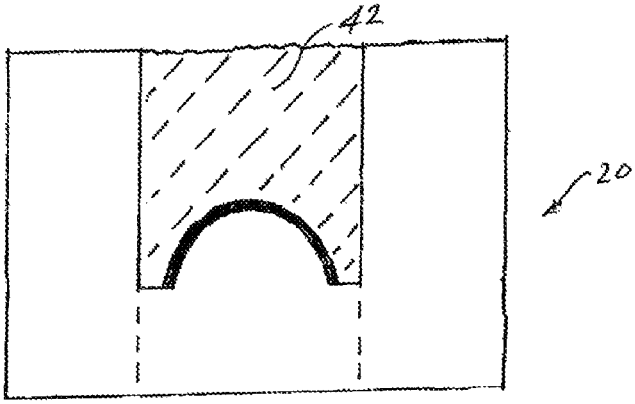

The width of the trough 22 at the upper surface 21 of the carcass 20, may be the same as the width extending across the bottom portion of the trough 22 from the first side channel 25 to second side channel 26, with side walls 29 and 30 of the trough 22 extending vertically from the respective outer edges of the side channels 25 and 26 as shown in FIGS. 3A and 3C.

Figure 3D:
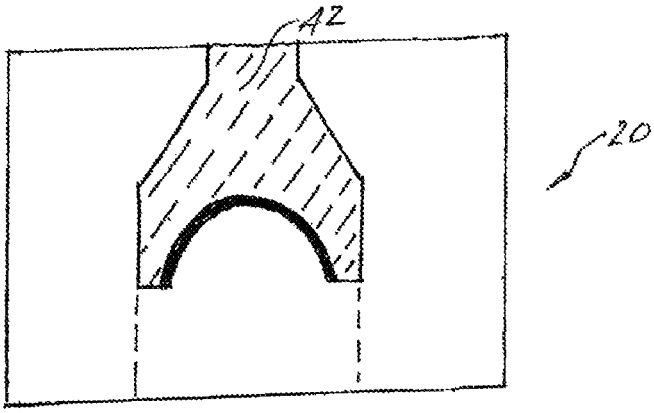

Alternatively, as shown in FIGS. 3B and 3D, the opening 32 at the upper surface 21 of the carcass 20 may be a narrowed or constricted opening, though still wide enough to allow the filling of the trough 22 with explosive material.

In this case, the width of the narrowed opening 32 is less than the width extending across the bottom portion 20 of the trough 22. The side walls 29, 30 of the trough 22 then forming a "necked" profile comprising firstly vertical wall portions and then sloping shoulder portions extending to the narrowed opening 32.

The upwardly curved projection 24 at the bottom portion of the trough, is clad with a liner 34, preferably formed as a composite of an elastomer and a powdered metal, or metal compound in powdered form, which may be copper, tungsten carbide, tungsten boride, tungsten, molybdenum, zirconium, iron, rare earth metals, magnesium, aluminium or mixtures of these materials. Liners are preferably pre-attached at manufacture of the carcasses.

As shown in FIGS. 4A to 4D the side walls 29, 30 of the trough 22 are optionally, respectively lined with inertial mass tamping strips 39 and 40. These strips 39, 40 may likewise comprise a composite of an elastomer and a powdered metal or metal compound, preferably selected from copper, tungsten, tungsten carbide, tungsten boride, iron, or mixtures of these materials.

Figure 4A:
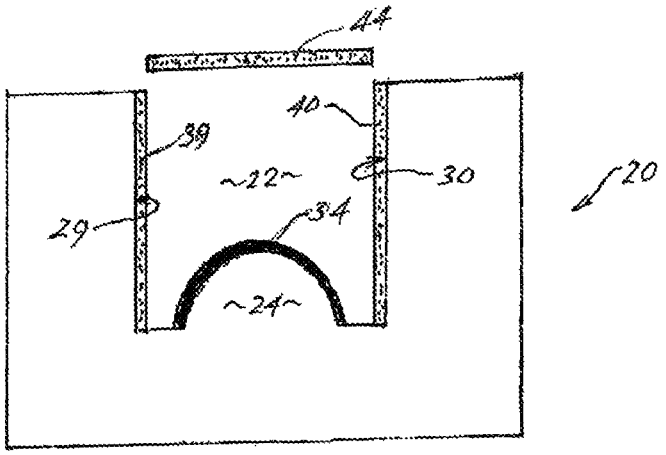
Figure 4B:
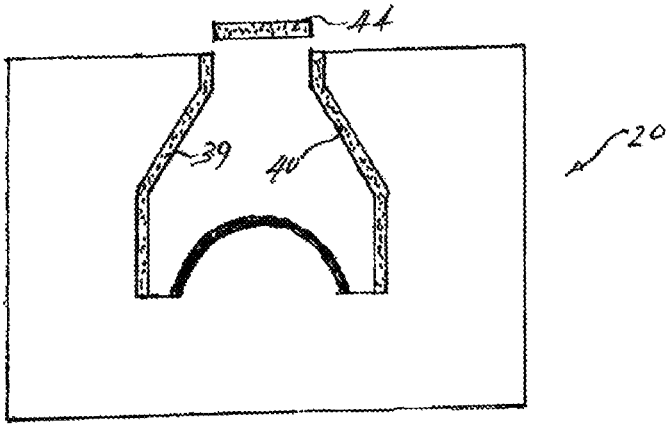
Figure 4C:
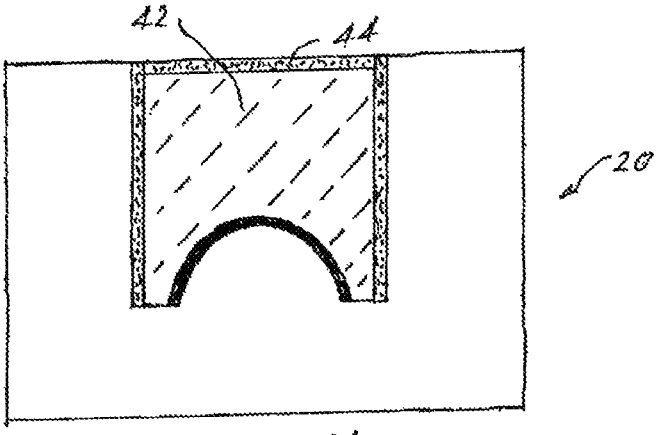
Figure 4D:
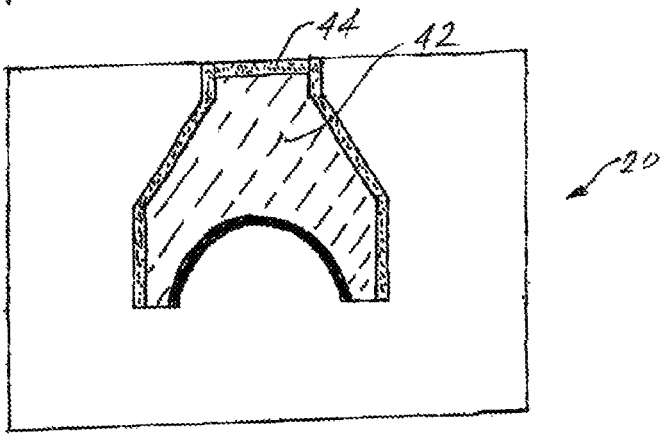

As can be seen in each of FIGS. 3C, 3D and 4C and 4D, the trough 22 may be filled with a suitable explosive material 42. In the arrangements of FIGS. 4C and 4D, additionally an optional tamping insert 44 may be laid over the explosive material to close the opening of the trough 22.

It is stressed that the field fillable flexible linear charge system works well with or without the addition of the strips of tamping inserts and carcass covers; the strips and covers providing increased penetration of the target where appropriate, through instantaneous mass tamping for the detonating explosive. This increases the penetrating performance of the liner.

Second Preferred Embodiment

With reference now to 7, the field filled flexible linear charge system 110 of the invention may be used in this example to cut through a metal pipe 112. A carcass 120 such as described in the embodiment above, is secured around the circumference of the pipe 112 and filled with explosive material.

Detonation of the charge destroys a ring of material of the pipe leaving the pipe severed.

Third Preferred Embodiment

In a further arrangement of the invention, the system may be adapted to cut a sheet of material into two or more pieces. In this instance, a carcass of sufficient length is laid across the width or length of the sheet to be cut and filled as described above with an explosive material. Detonation cuts the sheet into two.

Personnel may bring to a site at which an aperture is to be cut into a surface, a pipe or sheet of material is to be cut through, and the components required for building the desired carcass 20 to suit the conditions found at the site. These components include plastic explosive material, primers and detonators and lengths of the foam carcass 20, either preformed as an integral trough, or with separate side and bottom sections for assembly into a trough, and lengths of the liner and inertial mass tamping strips.

The foam carcass 20 is then formed of side sections in the manner of a picture frame, or shaped into a circular or oval form as shown in FIGS. 1 and 2 and affixed to the surface which is to be penetrated by, for example, by double sided adhesive tape. After adding liner and inertial mass tamping strips, the trough 22 in the carcass 20 is filled with plastic explosive material and one or more primers and detonators attached.

Thus, in these embodiments, the user simply needs to carry nominated lengths of the empty flexible linear charge, which are of a much reduced mass than existing flexible linear charges, and simply fill the charge carcass 20 with plastic explosive when the charge is needed for a cutting task. The charge carcass 20 can be filled with plastic explosive 42 either before it is attached to the target structure, or after it is attached, depending on circumstances. Plastic explosive is always carried by combat engineering and special forces demolition teams or SWAT police teams as a matter of course. The empty field filled flexible carcass 20 need only be filled exactly to the task requirements. A variety of charge carcasses may be carried by the combat teams, to suit a variety of tasks.

There are also advantages for commercial demolition operators, who can cut the charge carcasses exactly to required length and fill with either plastic explosive or high velocity commercial dynamite, and perhaps with high velocity emulsion explosive, depending on task requirements.

Figure 7:
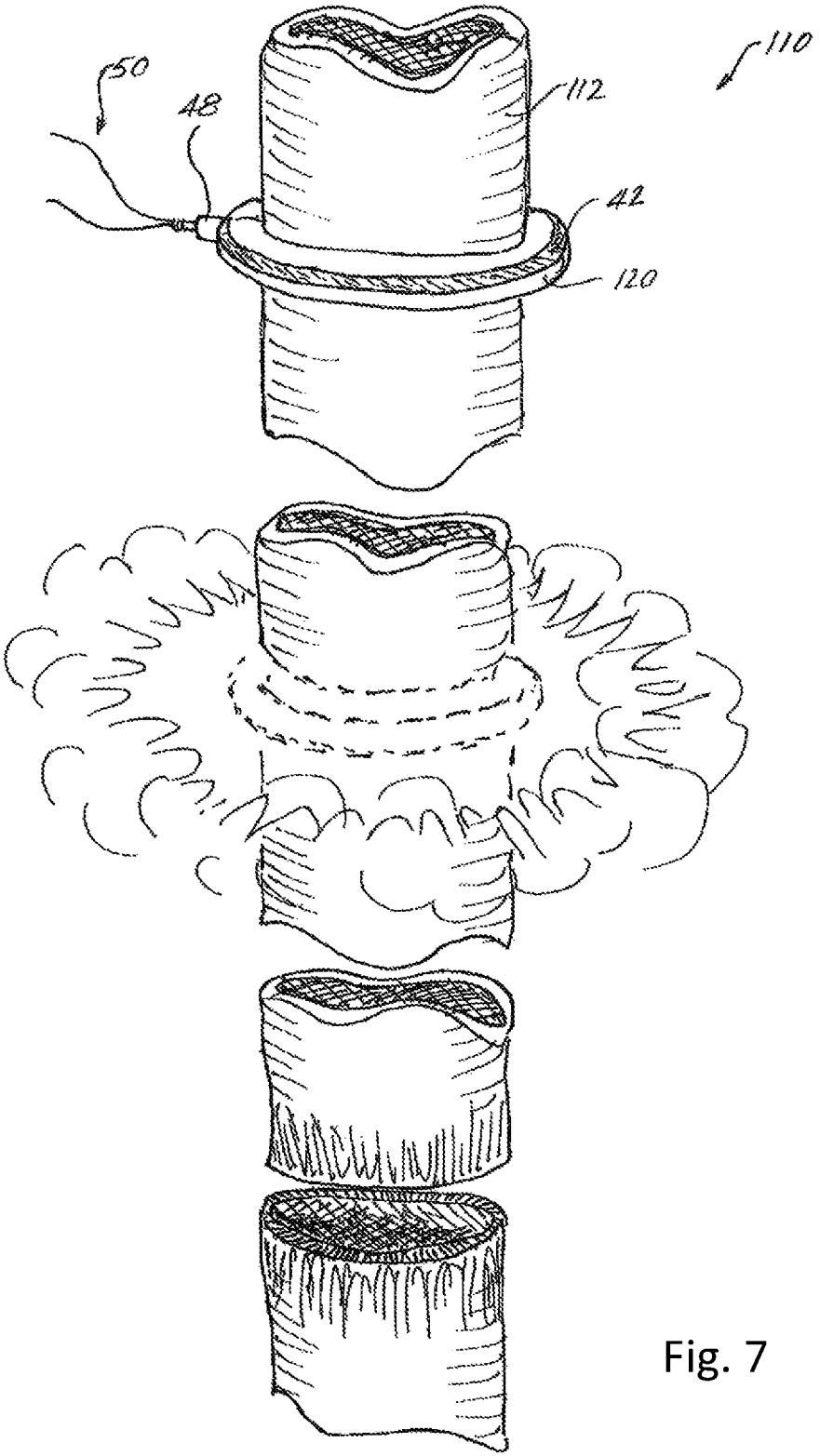
FIG. 7 is a perspective view of a further example of a field filled flexible linear charge system in use.
Figure 8A:
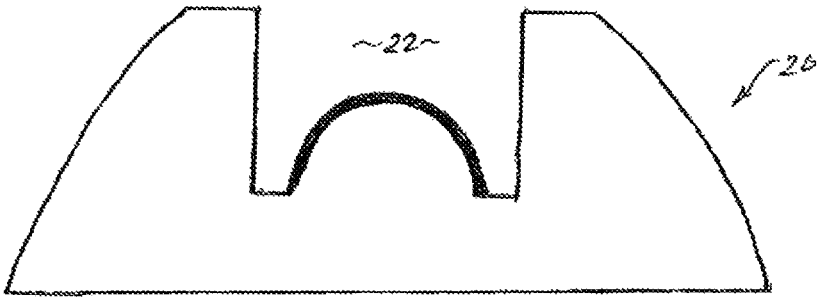
FIGS. 8A to 8C are sectioned views of a further preferred carcass for the field filled flexible charge system of the invention.
Figure 8B:
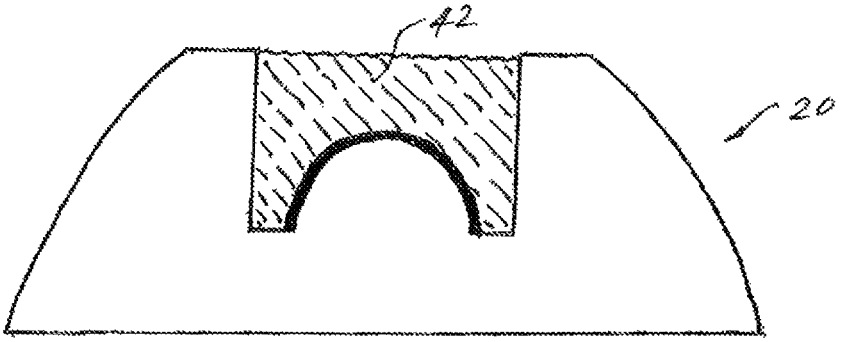
Figure 8C:
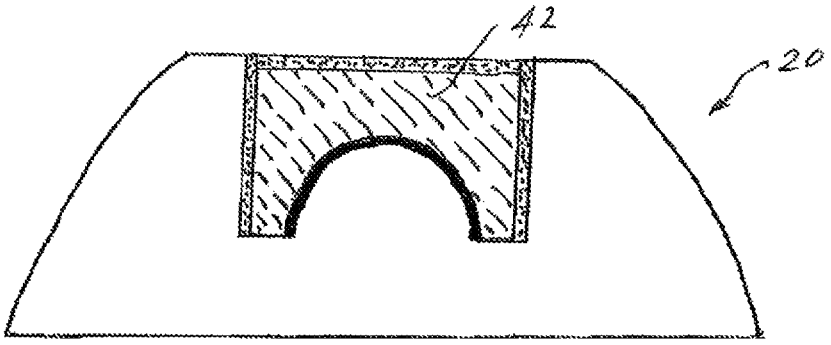

As shown in each of FIGS. 1, 2 and 7, after a carcass 20 has been positioned in the required location and filled with an explosive 42, one or more boosters 48 with detonator cords and detonators are attached to the explosive assembly and detonation wiring 50 led to a priming assembly 52.

The field fillable flexible charge system may conveniently be provided to field personnel in kit form, the kit including lengths of carcasses, optional tamping strips, one or more selected explosives and detonating cord and igniters.

Figure 9:
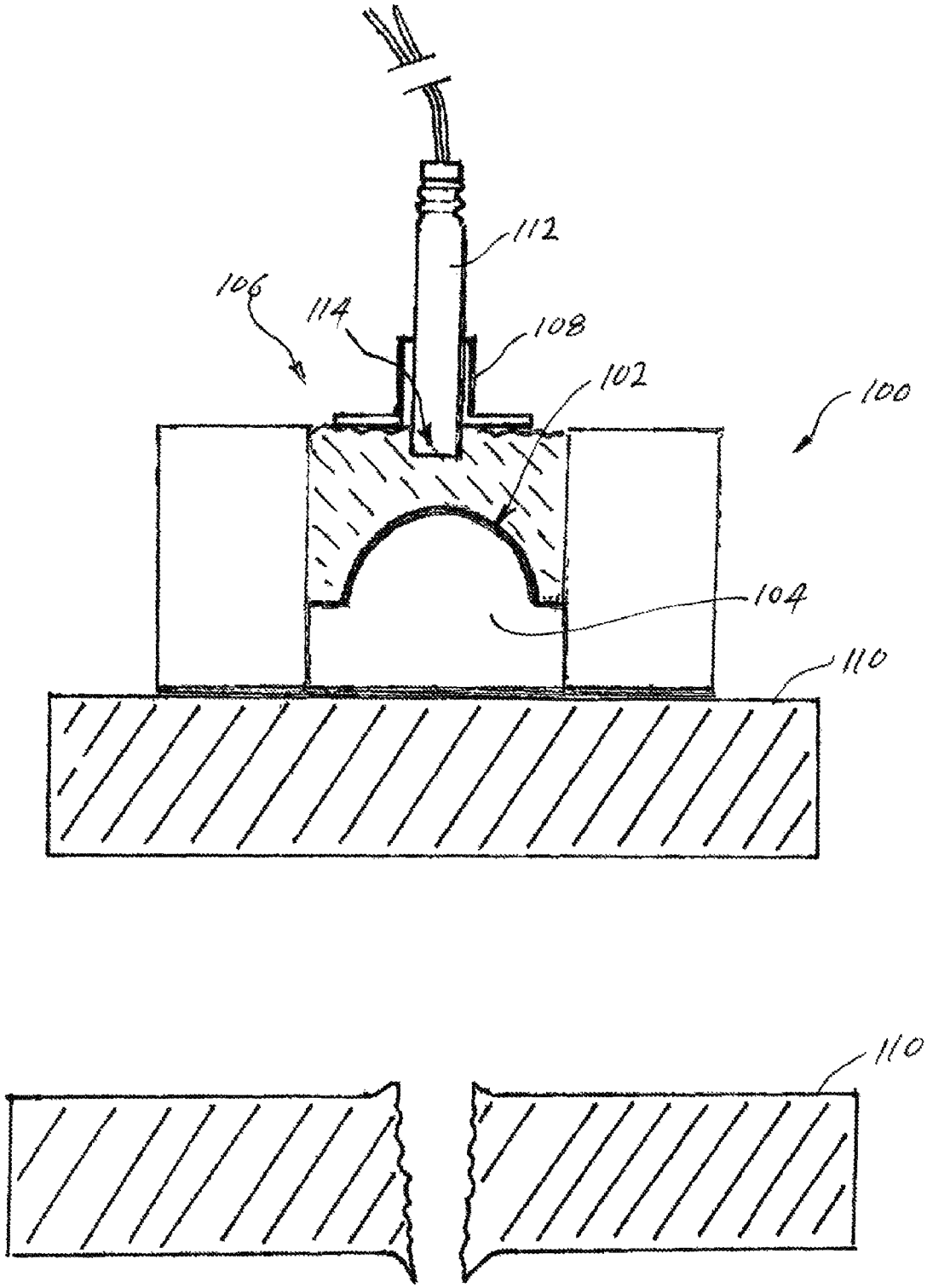
FIG. 9 is a cross section view of a carcass filled with explosive material and a detonator assembly.

For example, as shown in FIG. 9 a field filled flex casing 100 is prepared with a hemispherical cross section metal carbide/polyisobutylene liner 102 affixed over a hemispherical cross section, linear foam element 104 placed inside a foam trough 106, closed at both ends.

The casing is then hand filled with sufficient explosive material (for example PE4 plastic explosive) to completely fill the trough. In this example, the height of the explosive above the apex of the hemispherical cross section was 10 mm, and the width at the base of the liner to the side walls of the trough approximately 5 mm.

The trough can then be provided with a detonator locator 108 at one end of the explosive filled trough. The assembly of the casing, explosive fill and detonator locator is than applied to the target surface to be penetrated. In this example the target surface was that of a 20 mm steel plate 110, somewhat shorter than the length of the explosive filled casing, with the casing arranged so as to leave an air gap of some 12 mm.

An electric detonator 112 (for example a No 8*detonator) was then placed in the detonator locator with the explosive end 114 of the detonator about 5 mm into the PE4 plastic explosive and fired, resulting in a complete severing of the steel plate.

Figure 10:
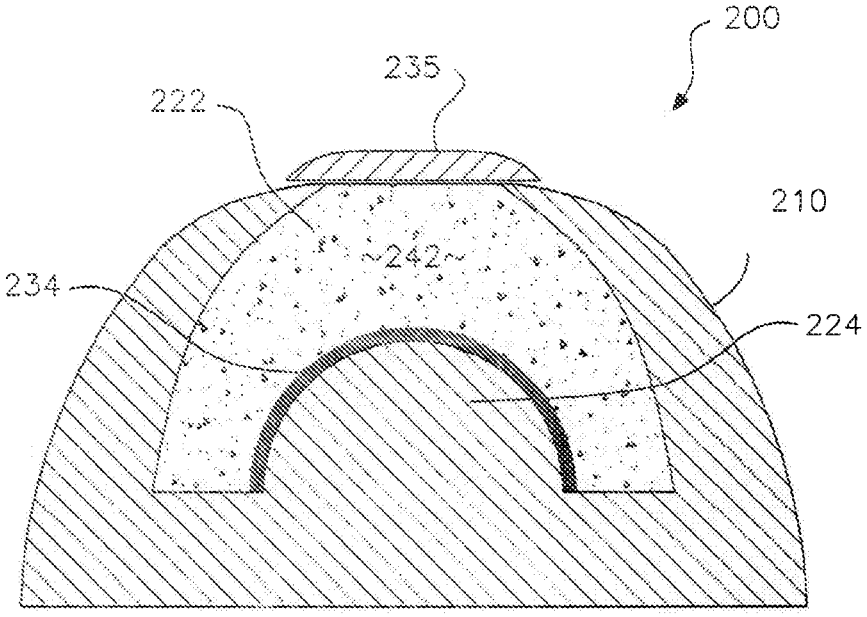
FIGS. 10 to 14 are cross section views of further embodiments of a carcass fillable or filled with an explosive material.

In one alternative embodiment of a linear charge system 200 as shown in FIG. 10, a carcass 210 may be configured similar to those shown in FIGS. 6B, 6D and 8A through 8C, but preferably in this instance the carcase is curved to at least partially arch over the trough 222 into which the explosive material 242 may be placed. In common with these earlier described embodiments, the arrangement of FIG. 10 includes the curved upward projection 224, overlaid with a liner 234. Additionally, in this embodiment, the explosive material may be covered by a carcass cover or cap 235, of the same or similar material as that of the carcass 210, effectively closing off the trough 222 to give a greater explosive effect.

The above described examples of linear charges may be described as un-tamped systems. Although as un-tamped arrangements these have a lesser penetrating performance (of the order of 10%) when applied to steel than tamped systems, they have the advantage of less mass and are thus easier to carry. Other advantages include a less lethal "back blast" since there is no copper or other metallic/rubber composite tamping liner overlaying the explosive, and they are cheaper to manufacture. Moreover, the unique and effective shape of the charge of these un-tamped systems as well as the unique effectiveness of the metal carbide liner are the same as for tamped arrangements.

Figure 11:
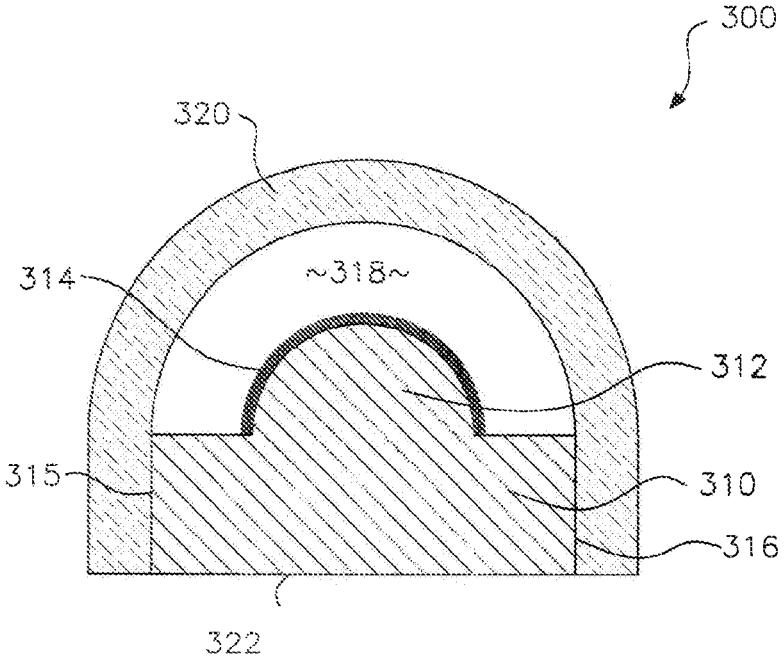

In another preferred arrangement as depicted in FIG. 11, a linear charge 300 may again be configured as an extruded, closed cell carcass 310. In common with the forgoing embodiments, the carcass 310 is formed with a central, upwardly arching projection 312 over which is placed a cutting sheet liner 314, for example of a dense material such as copper/Polyisobutylene sheet. The liner 314 extends between the surfaces of the foam carcass 310 which extend outwardly from either side of the upwardly arching projection 312.

Figure 11A:
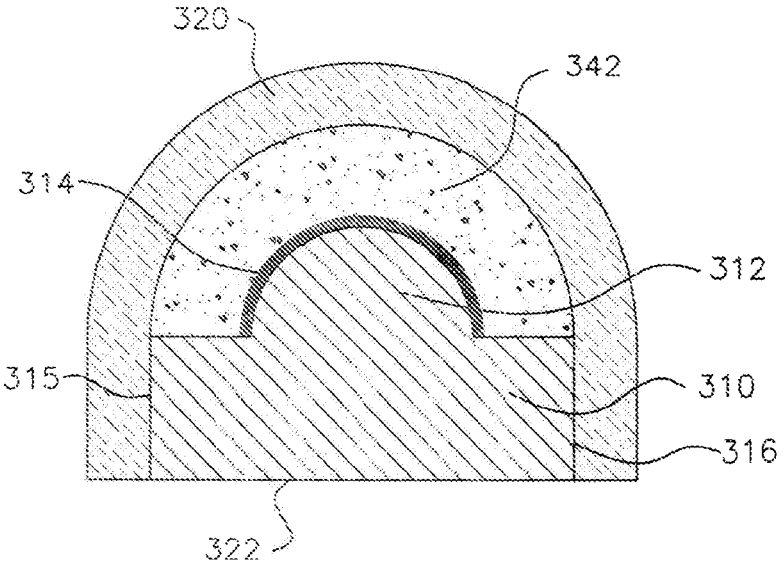

A foam carapace 320, substantially following the curvature of the central projection 312 and the liner 314, forms an arched cover over the carcass including the opposing outer sides 315/316 of the carcass and extending down to be level with its underside surface 322. This arrangement leaves an arcuate space 318 between the upper surface of the liner 314 and the inside surface of the carapace 320. In this form of the linear charge element of this embodiment, this arcuate space 318 may be filled at a site for use by pouring in a granular explosive material 342 as shown in FIG. 11A or hand packing in a plastic or malleable explosive as previously described. Alternatively, the explosive material may be included in the linear charge element at manufacture.

Further Embodiments

Figure 12A:
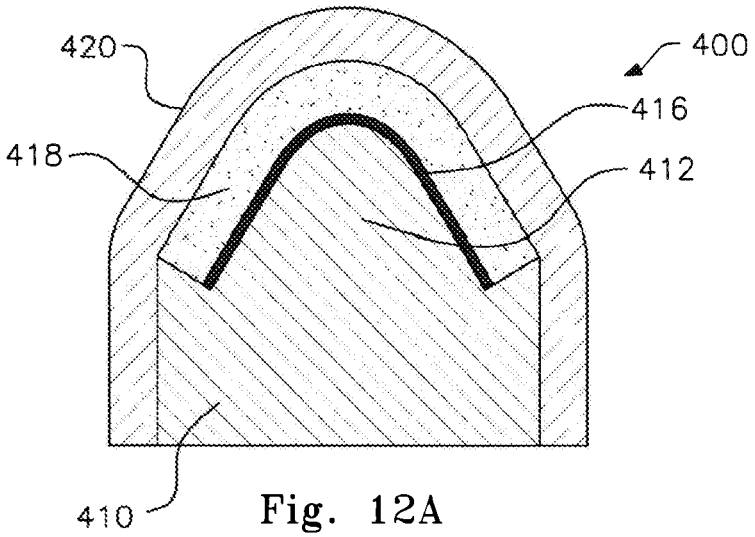
Figure 12B:
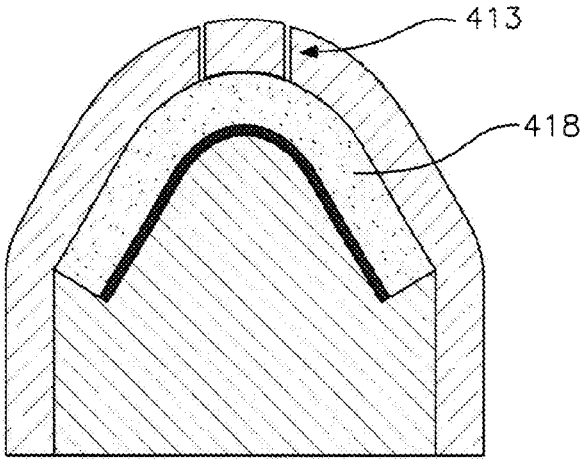
Figure 12C:
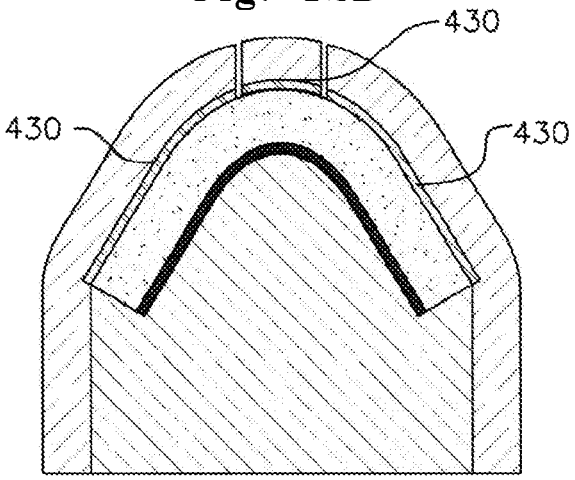

With reference now to FIGS. 12A to 12C, in a variation on the previously described embodiment of FIG. 11, in these preferred embodiments of a linear charge element 400, the central upward arching projection 412 of a closed cell carcass 410, and the foam carapace 420 are of ellipsoidal form.

The configuration of FIG. 12A in which the carapace 420 forms a continuous structure enclosing the explosive material 418 and liner 416, both also of ellipsoidal form, so that this embodiment of FIG. 12A is adapted to manufacture ready for use.

The arrangement of FIG. 12B is identical to that of FIG. 12A except that in this instance the carapace 420 is provided with a channel 413 extending the length of the linear charge element through which the explosive material 418 may be introduced. A closing strip 415 is then inserted into the channel prior to detonation.

This arrangement is also adopted for the embodiment of FIG. 12C although in this instance the inner surfaces of the carapace 420 and the closing strip 415 have been provided with tamping liners 430.

Figure 13A:
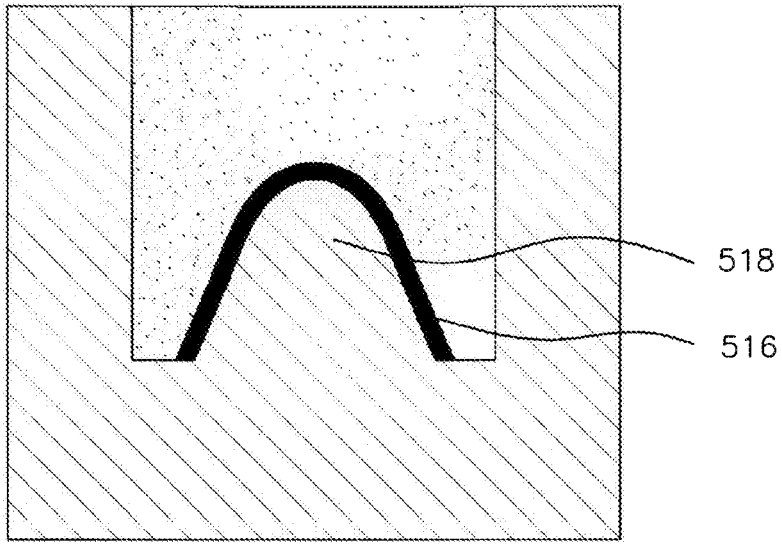
Figure 13B:
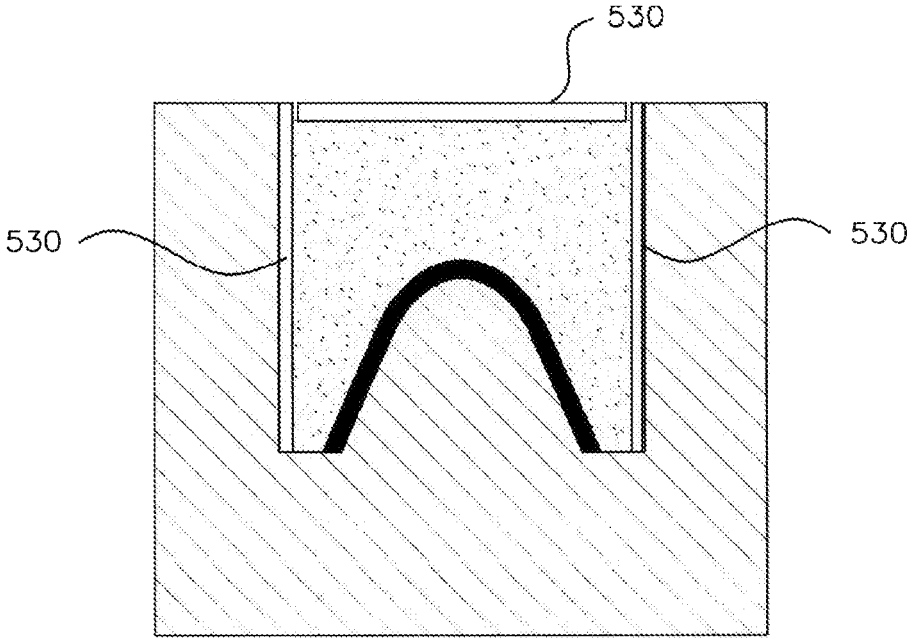

The ellipsoidal form of the central upward arching projection, may also be advantageously used in those forms of the carcass being of generally rectangular section in which the projection is located in a channel, such as in the embodiments of FIGS. 3A, 3C, 4A and 4C described above. Thus, as shown in FIGS. 13A and 13B, the liners 516 and the surface of the explosive material in contact with the liners, follow the ellipsoidal form of the projection 518. Again, in this embodiment, the explosive material may be covered with, and the channel side may be lined, with tamping strips 530. As shown in FIG. 13B.

Figure 5A:
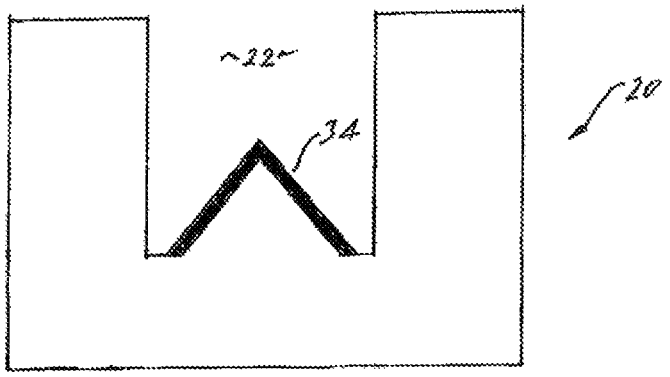
FIGS. 5A to 5D are sectioned views of further preferred embodiments of carcasses for field filled flexible charge systems.
Figure 5B:
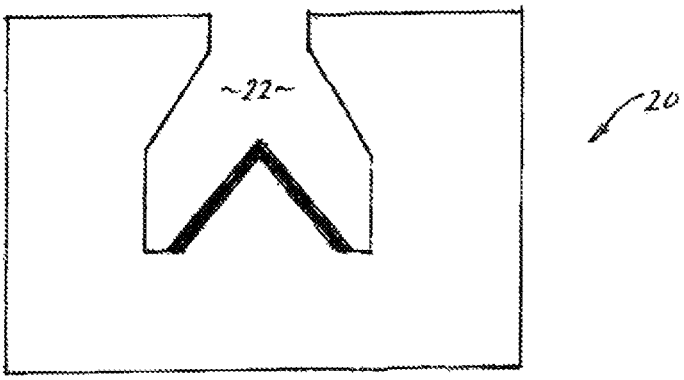
Figure 5C:
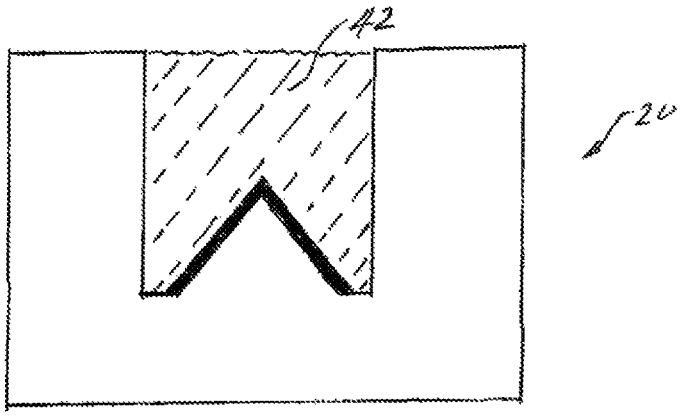
Figure 5D:
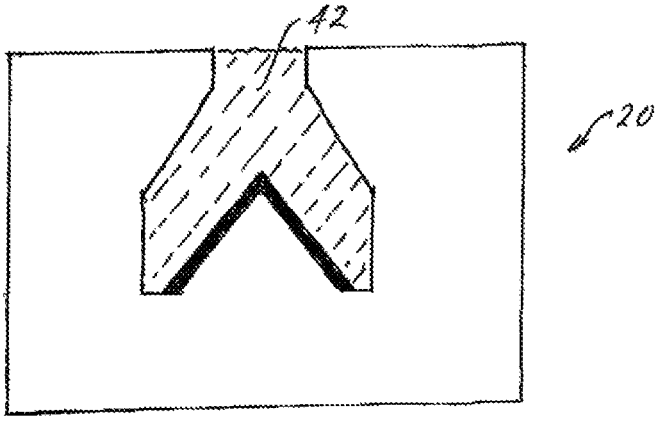
Figure 6A:
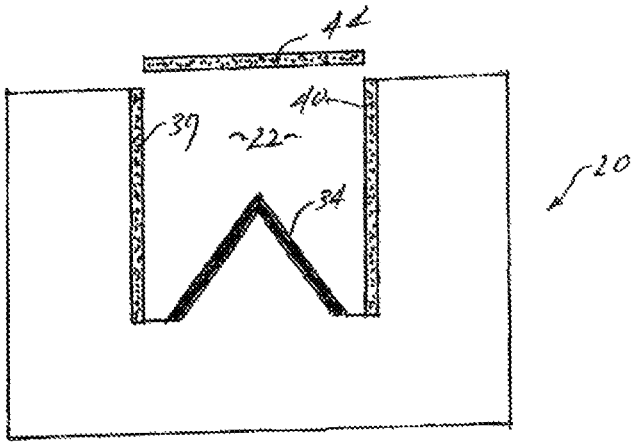
FIGS. 6A to 6D show the carcasses of FIGS. 5A to 5D prepared with tamping inserts strips and a liner.
Figure 6B:
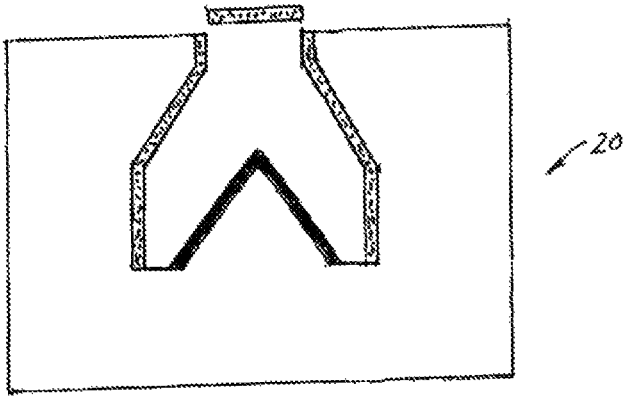
Figure 6C:
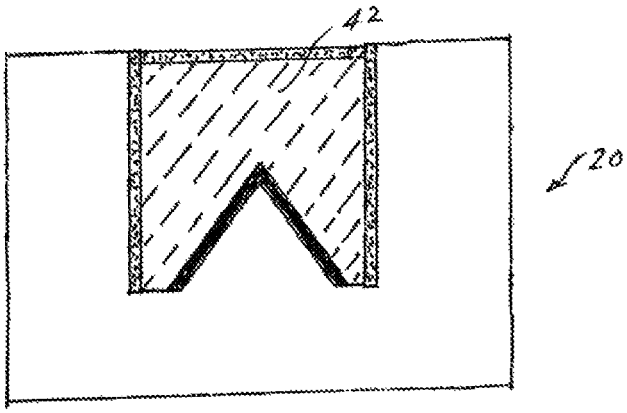
Figure 6D:
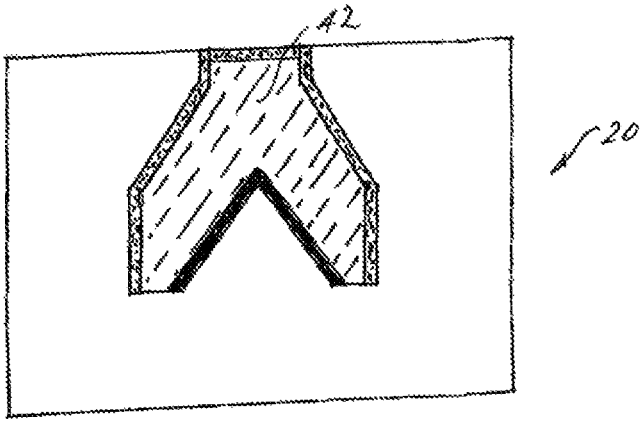
Figure 14A:
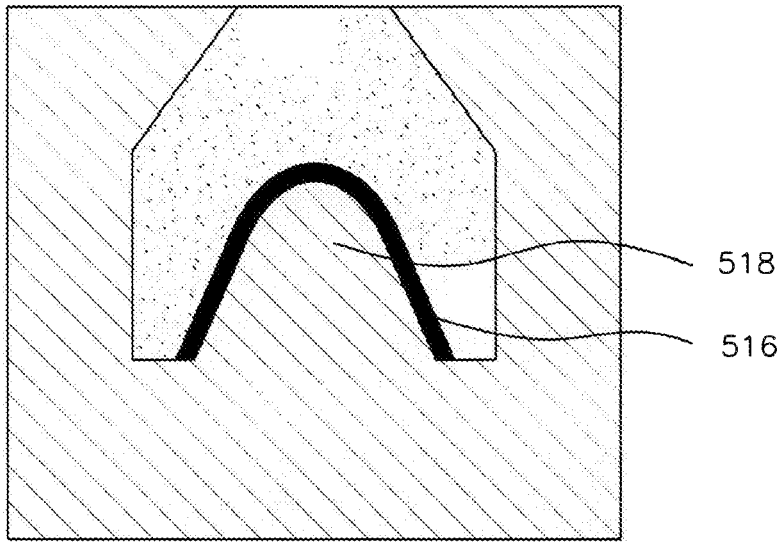
Figure 14B:
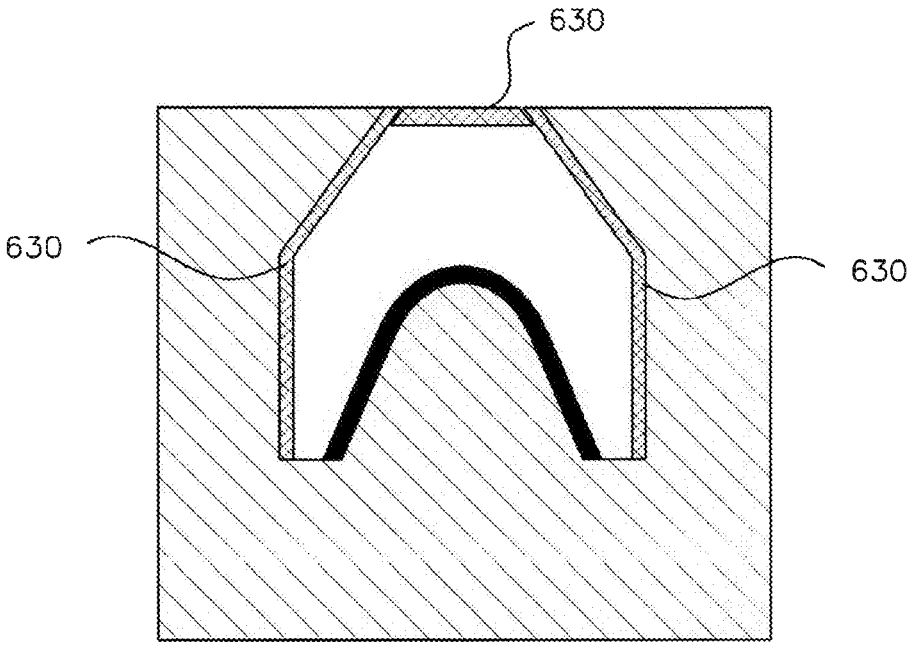

FIGS. 14 and 14A show further variations of configurations of the above described embodiments of FIGS. 5B and 5D in that the central upwardly aching projection is of ellipsoidal form.

INDUSTRIAL APPLICABILITY

The linear charge system of the invention provides for a fast, efficient and flexible means for cutting through surfaces, either for use by law enforcement, military or industrial use, especially where time is a constraint. It also reduces the necessary explosives related inventory that currently needs to be carried by military and police services, and provides a robust and adaptable industrial demolition tool that helps to make industrial demolition tasks quicker and easier.

The invention claimed is:

1. A field filled, flexible linear charge system for cutting through material by explosive detonation; the system including a flexible carcass for application to a surface; the carcass including a trough extending downwardly from an upper surface of the carcass and extending the length of the carcass; the carcass formed as a homogeneous body of closed cell flexible foam extending between a flat base and the upper surface; the trough including first and second side channels flanking an upwardly extending projection of the homogeneous body; the projection clad with a tamping strip liner formed as a composite of an elastomer and powdered metal; the trough in the carcass adapted for filling with an explosive compound at a site of assembly for use.

2. The system of claim 1 wherein the carcass is formed as a perimeter for an aperture to be cut through a sheet of material.

3. The system of claim 1 wherein the carcass is placed around a perimeter of a metal pipe to be severed.

4. The system of claim 1 wherein the carcass is placed across a width or length of a sheet of material to cut the sheet into two sections.

5. The system of claim 1 wherein the carcass is formed of a closed cell flexible foam; the trough adapted for receiving the explosive compound.

6. The system of claim 5 wherein a bottom portion of the trough includes an upwardly curved projection extending the length of the carcass.

7. The system of claim 6 wherein the upwardly curved projection is flanked by respective said first and second side channels along each side of the upwardly curved projection.

8. The system of claim 6 wherein the upwardly curved projection is clad with the liner formed as a composite of an elastomer and a metal or metal carbide or mixtures of these materials in powdered form.

9. The system of claim 8 wherein the metal or metal compound in powdered form is copper, tungsten, tungsten carbide, tungsten boride, molybdenum, zirconium, iron, rare earth metals, magnesium, aluminium or mixtures of these materials.

10. The system of claim 5 wherein the width of the opening at the upper surface of the carcass is the same as the width extending across the bottom portion of the trough from first side channel to second side channel; side walls of the trough extending vertically from outer edge of the side channels.

11. The system of claim 5 wherein the opening at the upper surface of the carcass is a narrowed opening; the width of the narrowed opening being less than the width extending across the bottom portion of the trough; the side walls of the trough forming a necked profile comprising vertical wall portions and sloping shoulder portions extending to the narrowed opening.

12. The system of claim 11 wherein the narrowed opening may be provided with a tamping cap.

13. The system of claim 5 wherein side walls of the trough are lined with inertial mass tamping strips.

14. The system of claim 13 wherein the inertial mass tamping strips are formed as a composite of an elastomer and a metal or metal compound in powdered form; the metal being tungsten, tungsten carbide, tungsten boride, copper or iron or mixtures of these materials.

15. The system of claim 5 wherein the carcass is covered by a closed foam carcass cover of width substantially equal to the width of the carcass; the closed foam carcass cover including an embedded inertial mass tamping strip of width equal to or greater than the width of the opening in the upper surface of the carcass.

* * * * *